US006230443B1

(12) United States Patent
Schultz

(10) Patent No.: US 6,230,443 B1
(45) Date of Patent: May 15, 2001

(54) HARDWARE MOUNTING

(75) Inventor: Steven E. Schultz, Demotte, IN (US)

(73) Assignee: Ashland Products, Inc., Lowell, IN (US)

( * ) Notice: Subject to any disclaimer, the term of this patent is extended or adjusted under 35 U.S.C. 154(b) by 0 days.

(21) Appl. No.: 09/305,490

(22) Filed: May 5, 1999

Related U.S. Application Data

(60) Provisional application No. 60/105,809, filed on Oct. 27, 1998.

(51) Int. Cl.[7] ..... E05D 15/22

(52) U.S. Cl. ..... 49/183; 49/181

(58) Field of Search ..... 49/174, 175, 176, 49/177, 181, 182, 183, 184, 185, 449; 292/175

(56) References Cited

U.S. PATENT DOCUMENTS

| | | | | |
|---|---|---|---|---|
| 16,228 | | 12/1856 | Copeland . | |
| 1,781,729 | | 11/1930 | Major . | |
| 2,568,273 | | 9/1951 | Clark . | |
| 2,965,935 | | 12/1960 | Olsen . | |
| 3,080,621 | | 3/1963 | Mendelsohn . | |
| 3,122,797 | | 3/1964 | Segre . | |
| 3,841,674 | * | 10/1974 | Bisbing et al. | 242/42 |
| 3,850,464 | * | 11/1974 | Bisbing et al. | 292/175 |
| 4,167,835 | | 9/1979 | Nobes et al. . | |
| 4,400,026 | | 8/1983 | Brown, Jr. . | |
| 4,475,311 | | 10/1984 | Gibson . | |
| 4,482,178 | * | 11/1984 | Damiana | 292/175 |
| 4,553,353 | | 11/1985 | Simpson . | |
| 4,578,903 | | 4/1986 | Simpson . | |
| 4,581,850 | | 4/1986 | Simpson . | |
| 4,622,778 | | 11/1986 | Simpson . | |
| 4,669,765 | | 6/1987 | Ullman . | |
| 4,790,579 | | 12/1988 | Maxwell et al. . | |
| 4,791,756 | | 12/1988 | Simpson . | |
| 4,824,154 | | 4/1989 | Simpson . | |
| 4,837,975 | | 6/1989 | Simpson . | |
| 4,901,475 | | 2/1990 | Simpson . | |
| 4,917,413 | | 4/1990 | Jason et al. . | |
| 5,028,083 | | 7/1991 | Mischenko . | |
| 5,068,932 | | 12/1991 | Chang . | |
| 5,096,240 | | 3/1992 | Schultz . | |
| 5,121,951 | | 6/1992 | Harbom et al. . | |
| 5,121,952 | | 6/1992 | Jason . | |
| 5,127,685 | * | 7/1992 | Dallaire et al. | 292/175 |
| 5,139,291 | | 8/1992 | Schultz . | |
| 5,145,221 | * | 9/1992 | Pennebaker et al. | 292/175 |
| 5,165,737 | | 11/1992 | Riegelman . | |
| 5,618,067 | | 4/1997 | Carlson et al. . | |
| 5,669,180 | * | 9/1997 | Maier | 49/181 |
| 5,669,639 | | 9/1997 | Lawrence . | |
| 5,671,958 | | 9/1997 | Szapucki et al. . | |
| 5,806,900 | * | 9/1998 | Bratcher et al. | 292/137 |
| 5,829,196 | * | 11/1998 | Maier | 49/181 |
| 5,927,013 | * | 7/1999 | Slocomb et al. | 49/181 |
| 5,970,656 | * | 10/1999 | Maier | 49/181 |
| 5,996,283 | * | 12/1999 | Maier | 49/181 |
| 6,021,603 | * | 2/2000 | Prete et al. | 49/183 |

* cited by examiner

*Primary Examiner*—Daniel P. Stodola
*Assistant Examiner*—Curtis A. Cohen
(74) *Attorney, Agent, or Firm*—Wallenstein & Wagner, Ltd.

(57) ABSTRACT

A hardware mounting has one preferred embodiment as a tilt-latch. The tilt-latch (10) is adapted for releasably securing a pivotable sash window disposed within opposed guide rails on a master frame of a window sash assembly. The sash window (12) comprises a top sash rail (20), a base (22) and two stiles (24,26) connected together at their extremities. The top sash rail (20) has an intermediate wall (52) having an opening (56). The tilt-latch (10) comprises a housing (30) adapted to be supported in the top rail (20). The housing (30) further has an outward end opening and a bottom wall (38). The housing (30) has a tab (40) depending from the bottom wall (38) adapted to be received by the intermediate wall opening (56). The housing (30) also has a latch bolt (32) disposed within the housing (30) and having a nose (34) adapted for engaging a respective one of the guide rails.

47 Claims, 6 Drawing Sheets

HARDWARE MOUNTING

RELATED APPLICATION

The present application claims the benefit of U.S. Provisional Application No. 60/105,809, filed on Oct. 27, 1998, which is expressly incorporated herein by reference.

TECHNICAL FIELD

The present invention relates to a hardware mounting for use, for example, in window and door applications and, more particularly to a tilt-latch mounted in a top sash rail of a pivotal sash window.

BACKGROUND OF THE INVENTION

Pivotal sash windows adapted for installation in a master frame of a sash window assembly are well-known. The sash window assembly typically has opposed, vertically extending guide rails to enable vertical reciprocal sliding movement of the sash window in the master frame while cooperatively engaged with the guide rails. The sash window has a top sash rail, a base and a pair of stiles cooperatively connected together at adjacent extremities thereof to form a sash frame, usually a rectangular frame. Typically, a pair of spaced tilt-latches are installed on, or in, opposite ends of the top sash rail.

Each tilt-latch is generally comprised of a housing having an outward end opening and a latch bolt disposed within the housing. A spring disposed within the housing generally biases the latch bolt through the outward end opening to engage the guide rails of the master frame. The latch bolt can have a control button to allow for actuation of the latch bolt. An operator can use his finger to engage the button and actuate the latch bolt wherein the latch bolt is retracted into the housing. The control button can take the form of a hollowed out portion to accommodate the operator's finger. Retraction of the latch bolt releases the latch bolt from the guide rail. When the latch bolts of the opposed tilt-latches are actuated simultaneously, the sash window can then be pivoted from the master frame.

One type of tilt-latch is called an internal tilt-latch. The internal tilt-latch is mounted in the top sash rail. The top sash rail is typically extruded and, therefore, is sometimes referred to as an extrusion. The top sash rail accommodates the tilt-latch substantially within the extrusion. Generally, the internal tilt-latch comprises a housing having a latch bolt which is actuated by a control button. The latch bolt of the tilt-latch extends from the housing and extrusion to engage the guide rail of the master frame. The top rail has an opening through its upper surface to allow access to the control button on the latch bolt. The internal tilt-latch is generally fixedly attached to the extrusion by screws. Typically, the screws pass through the top surface of the top rail to engage the internal tilt-latch. This type of mounting, however, is considered unsightly and typically requires an externally mounted control plate that covers the screws. The tilt-latch can also be screw-mounted wherein the screws pass through a bottom wall or intermediate wall of the extrusion, and similarly engage the internal tilt-latch. This type of bottom or side mounting, however, can interfere with the glass panes of the sash window and associated mounting and insulating materials. Additionally, if a screw-mounted, internal tilt-latch fails and requires replacement, the sash window may sometimes require disassembly to replace the tilt-latch. Furthermore, other types of hardware mountings such as pivot bars, sash locks, sweep locks, casement operators or vent stops can also require screw mountings which can experience similar drawbacks.

The present invention is provided to solve these and other problems.

SUMMARY OF THE INVENTION

It is an object of the present invention to provide a hardware mounting that can be mounted in a support structure wherein the mounting does not requires screws to achieve an acceptable mounting. In one preferred embodiment of the invention, the hardware mounting is a tilt-latch adapted for releasably securing a pivotable sash window to a master frame of a sash window assembly.

According to a first aspect of the invention, a hardware mounting is adapted to be mounted in a support structure having an inner wall. The inner wall has an opening. The hardware mounting has a housing adapted to be supported by the support structure. The housing has an outer wall and a first tab extending from the outer wall. The first tab is adapted to be received by the opening in the inner wall. The housing can also support a cooperative member.

According to another aspect of the invention, the housing has a second tab depending from the outer wall. The second tab is adapted to be received by a second opening in the second wall.

According to another aspect of the invention, the housing can be a tilt-latch housing and the cooperative member is latch bolt. The hardware mounting can also include a housing and the support structure is a window sash and the cooperative member is a pivot bar supported by the housing. The cooperative member could also be a sash lock for locking a pair of sash windows.

According to another aspect of the present invention, the master frame has opposed, vertically extending guide rails. The sash window has a top sash rail or top extrusion, a base and a pair of stiles cooperatively connected together at adjacent extremities to form a frame. The top sash rail has a first wall and a second or intermediate wall. The intermediate wall has a first opening therethrough. Similarly, the first wall has a slot therethrough. The slot in the first wall is positioned over the opening in the intermediate wall.

According to another aspect of the invention, the tilt-latch comprises a housing which is adapted to be supported in the top rail. The housing has a bottom wall, opposing side walls, a first end and a second end. A first tab depends from the bottom wall between the first and second ends thereof. The first tab is adapted to be received by the opening in the intermediate wall of the top sash rail. The housing further has an outward end opening at one end thereof. A latch bolt is disposed within the housing and has a first end, a second end, and a control button therebetween. The latch bolt further has a nose extending from the first end and adapted to engage a respective one of the guide rails for releasably securing the sash window to the master frame. Additionally, a leg proximal an end of the housing is adapted to engage the stile to locate the housing within the stile.

According to another aspect of the present invention, a portion of the first tab extends substantially perpendicular to the bottom surface of the housing to define a tab surface. The tab surface is adapted to engage a stop wall of the first opening in the intermediate wall. An angled surface of the first tab generally opposes the tab surface. Additionally, the first tab has a recess in the angled surface. The recess allows the first tab to receive a protrusion of the intermediate wall.

According to another aspect of the present invention the housing further comprises a second tab depending from the bottom wall. The second tab is adapted to be received by a second opening in the intermediate wall. A portion of the second tab extends substantially perpendicular to the bottom surface of the housing to define a tab surface. The tab surface is adapted to engage a stop wall of the second opening in the intermediate wall. An angled surface of the second tab generally opposes the tab surface. Additionally, the second tab may have a recess in the angled surface. The recess allows the second tab to receive a protrusion of the intermediate wall.

According to another aspect of the present invention, a means for biasing the latch bolt through the first end opening of the housing is also provided. The biasing means is contained within the housing and is connected at one end to the latch bolt.

Other features and advantages of the invention will be apparent from the following specification taken in conjunction with the following drawings.

DETAILED DESCRIPTION

Figure 1:
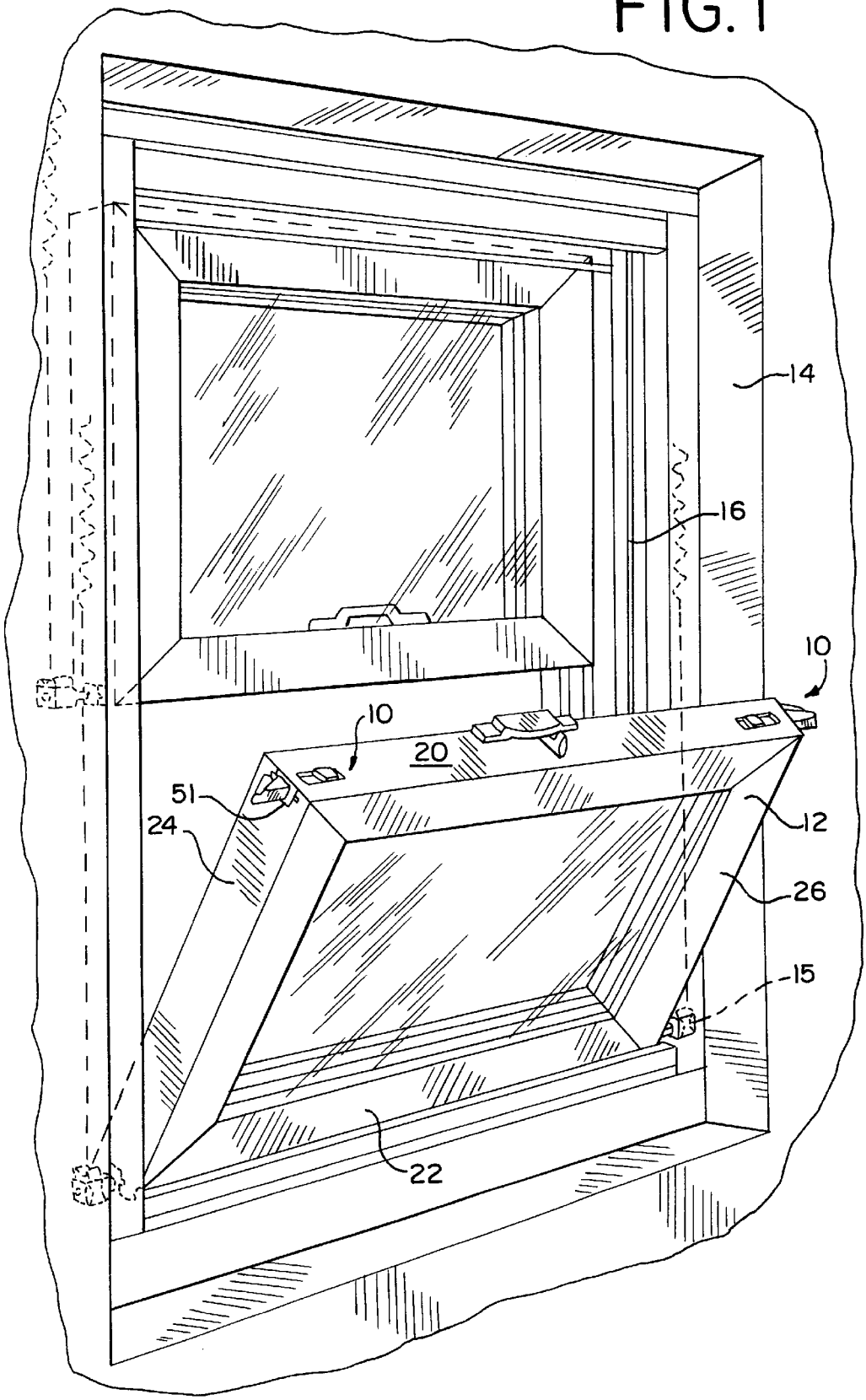
FIG. 1 is a front perspective view of a double-hung sash window assembly utilizing a tilt-latch according to the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
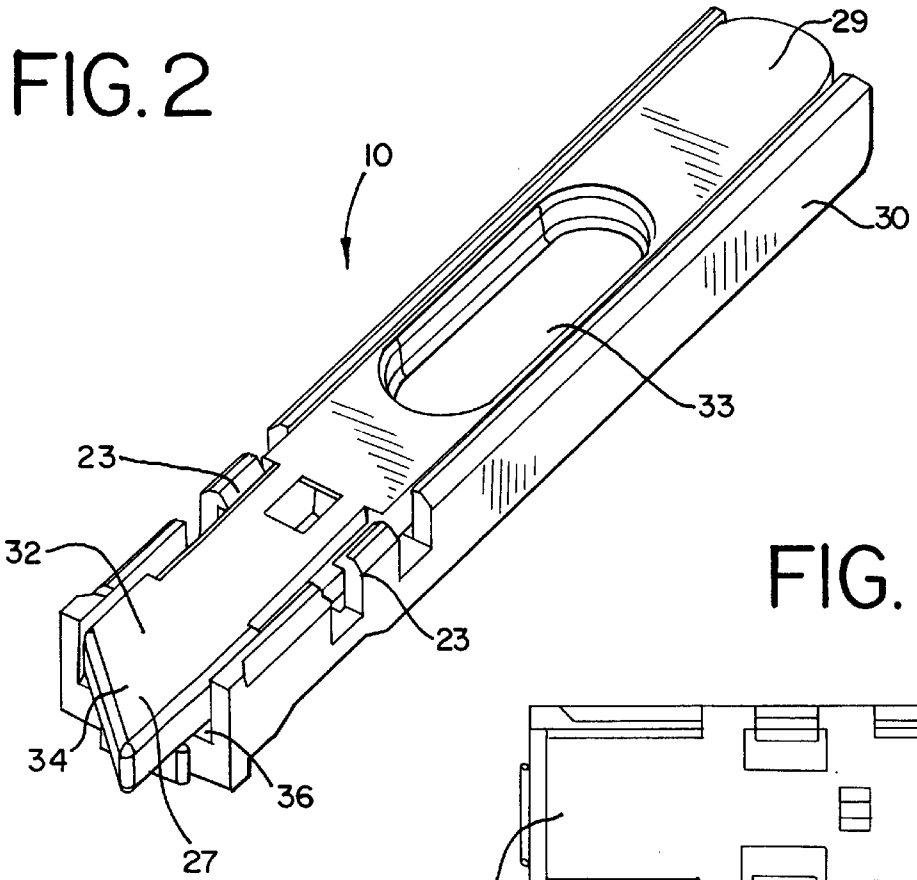
FIG. 2 is a perspective view of the tilt-latch of the present invention.

Referring now in detail to the drawings, and initially to FIGS. 1 and 2, there is shown one preferred embodiment of the hardware mounting of the present invention, in the form of a tilt-latch. As explained in greater detail below, however, the hardware mounting of the present invention can be utilized in many other applications in addition to tilt-latches. A tilt-latch is but one preferred embodiment. The tilt-latch, generally designated with the reference numeral 10, is used in a sash window assembly. The sash window assembly shown in FIG. 1 is a double-hung window assembly having a pivotal sash window 12 installed in a master frame 14. The tilt-latch 10, however, could also be used in other types of pivotal windows or structures. The sash window 12 is pivotally mounted to the master frame 14 by a pivot-comer/balance shoe assembly 15, and the tilt-latch 10 is adapted for releasably securing the sash window 12 to the master frame 14. As is well known, the master frame 14 has opposed, vertically extending guide rails 16. As shown in FIG. 1, the sash window 12 has a top sash rail 20, a base 22 and a pair of stiles 24,26, cooperatively connected together at adjacent extremities thereof to form a sash frame, typically rectangular although other shapes are possible. The sash frame could be made from extrusions or pulltrusions that are filled with fiberglass, epoxy, plastic, or wood chips. The sash frame could also be solid and made from wood, masonite or pressboard. The sash frame could be made from other materials as well including aluminum.

As shown in FIGS. 2–5, the tilt-latch 10 generally comprises a housing 30, a latch bolt 32, and a means for biasing the latch bolt 32 through an outward end opening 36 of the housing 30. The latch bolt 32 is adapted to be disposed within the housing 30. The latch bolt 32 has a first end 27, a second end 29, and a control button or actuator 33 therebetween. A nose 34 extends from the first end 27 of the latch bolt 32 and is adapted for engaging a respective one of the guide rails 16 of the master frame 14. The means for biasing the latch bolt 32 through the outward end opening 36 of the housing 30 is contained in the housing 30 and typically comprises a spring although other structures that can force the latch bolt 32 through the outward end opening 36 are possible. The actuator 33 of the latch bolt 32 is adapted to be engaged by the operator. In the preferred embodiment, the actuator 33 is a depression on the top surface of the latch bolt 32 as shown in FIG. 2. The actuator 33 may also comprise a protrusion on the latch bolt 32 sometimes referred to as a control button. The housing 30 is adapted to be supported by an inner or intermediate wall 52 of the top rail 20 of the sash window. Thus, the tilt-latch 10 of the present invention is commonly referred to as an internal tilt-latch.

Figure 8:
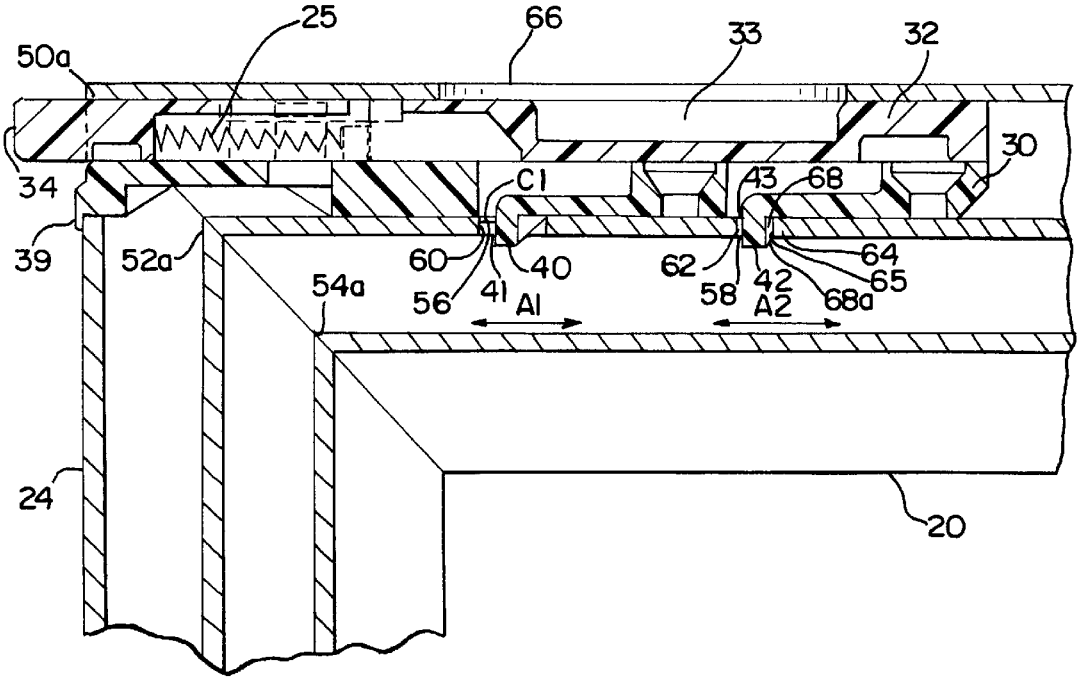
FIG. 8 is a partial front cross-sectional view of the sash window and tilt-latch of the present invention.

As further shown in FIGS. 2–5, the housing 30 of the tilt-latch 10 has a bottom wall 38, a pair of opposing side walls 35,37 extending from the bottom wall 38, a first end 47, a second end 49, an outward end opening 36 adjacent the first end 47, and a leg 39. In the preferred embodiment the housing is made of a molded plastic or other polymeric material. The outward end opening 36 provides for allowing the nose 34 of the latch bolt 32 to extend past the first end 47 of the housing 30. In the preferred embodiment the means for biasing the latch bolt 32 through the outward end opening 36 of the housing 30 is a spring 25 (FIG. 8). Generally, the spring 25 biases the latch bolt 32 from the housing 30 as is conventional. More specifically, the spring 25 has one end positioned abutting a wall of the latch bolt 32 and the other end of the spring 25 abutting a spring stop wall 31 of the housing 30 (FIG. 8). The combination of the spring 25 and latch bolt 32 provides for releasably securing the sash window 12 to the master frame 14. The housing 30 also has a pair of fingers 23 that extend inwardly from the sidewalls 35,37 and help maintain the latch bolt 32 in the housing 30. The housing 30 is also shown having a pair of screw holes. It is understood that the screw holes are completely unnecessary in the present invention. The housing 30 can be installed securely without the need for screws. Nevertheless, one could anchor the housing 30 with a screw if desired.

The housing further has the leg 39 that depends from the housing 30 proximal the first end 47 thereof. The leg 39 further extends past the bottom wall 38 thereof. The leg 39 is adapted to engage an outside surface of the stile 24,26 when the tilt-latch 10 is fully installed and secured in the sash window 12. The leg 39 prevents the tilt-latch 10 from being inserted into the sash window 12 further than is desired. While it is preferable that the leg 39 depend from the bottom wall 38, it could extend from other portions of the housing 30. In addition, the leg 39 could be eliminated. As explained below, the housing 30 can utilized alternative structure to prevent excessive travel of the housing 30 into the sash window 12.

Figure 3:
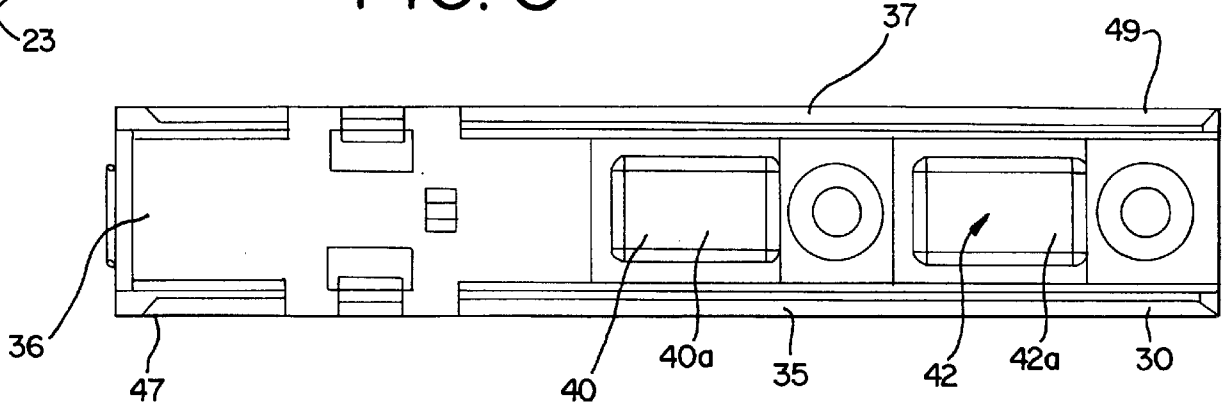
FIG. 3 is a top plan view of a housing of the tilt-latch of FIG. 2.
Figure 4:
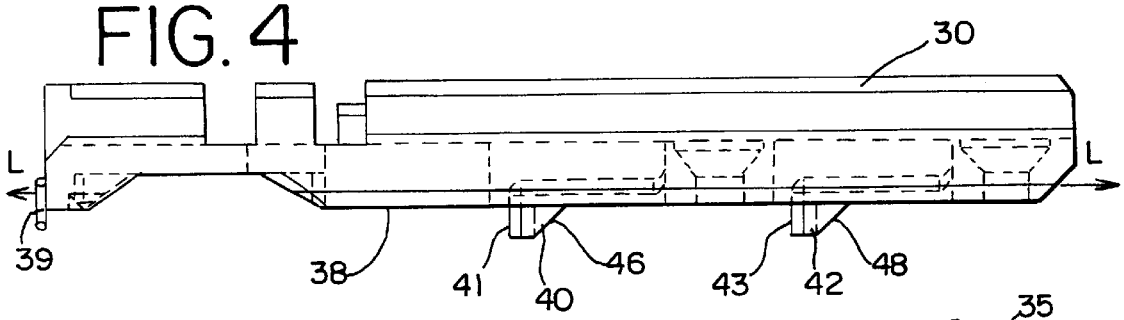
FIG. 4 is a side elevational view of the housing of the tilt-latch of FIG. 2.
Figure 5:
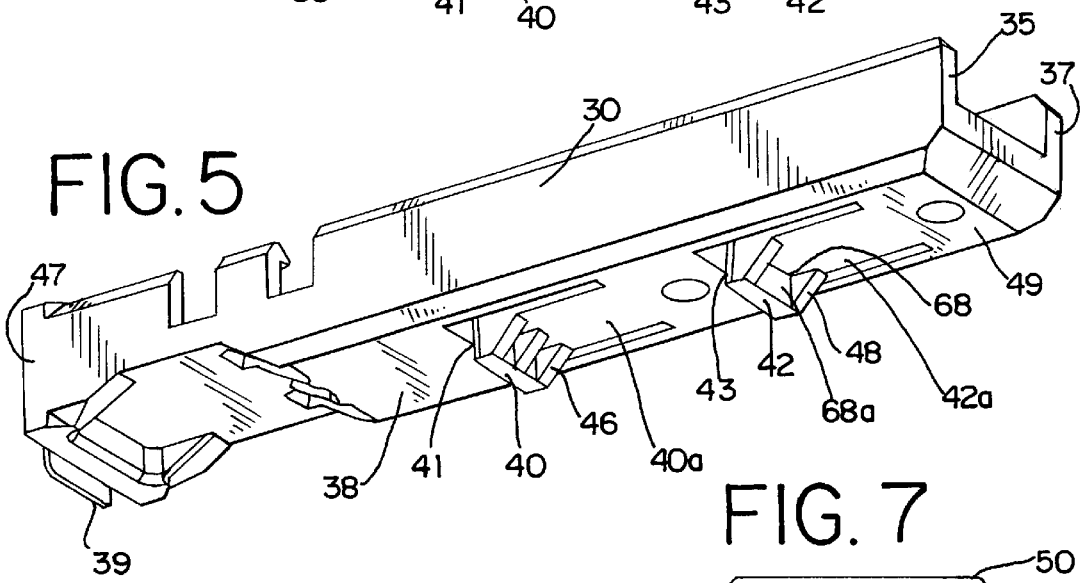
FIG. 5 is a bottom perspective view of the housing of the tilt-latch of FIG. 2.

As shown in FIGS. 3–5, the bottom wall 38 of the housing 30 has a first tab 40 depending from the bottom wall 38 and a second tab 42 depending from the bottom wall 38. The first and second tabs 40,42 are located between and spaced from the first and second ends 47,49 of the housing. The tabs 40,42 are aligned along a longitudinal axis L of the housing. The first tab 40 extends from a first flexible member 40*a* formed in the bottom wall 38. Similarly, the second tab 42 extends from a second flexible member 42*a* formed in the bottom wall 38. The flexible members 40*a*,42*a* allow the tabs 40,42 to flex as will be explained below. A portion of the first tab 40 and a portion of the second tab 42 extend beyond the bottom wall in a downward direction. Furthermore, the portion of the first tab 40 which extends beyond the bottom wall 38 also extends substantially perpendicular to the bottom wall 38 of the housing 30 to define a first tab surface 41. The first tab 40 also has an angled surface 46, or ramp surface, facing generally opposite the first tab surface 41. Similarly, the portion of the second tab 42 which extends beyond the bottom wall 38 also extends substantially perpendicular to the bottom wall 38 of the housing 30 to define a second tab surface 43. And, the second tab 42 also has an angled surface 48 facing generally opposite the second tab surface 43. The angled surface 48 preferably comprises a pair of angled surfaces that define a recess 68 in the second tab 42. The recess has a recess surface 68*a* opposite the second tab surface 43. The first tab surface 41 and the second tab surface 43 preferably face in the same direction towards the first end 47 of the housing 30. The first and second depending tabs 40,42 are adapted to be received by openings in the top rail 20 as will be described below. As the tabs 40,42 are spaced from the ends 47,49 of the housing 30, the tabs 40,42 are preferably not adapted to engage the stiles 24,26 such as a stile engaging tab disclosed in U.S. Pat. No. 5,139,291. As will be explained in greater detail below, the tabs 40,42 are positioned along the bottom wall at specific locations and at specific locations relative to one another to most optimally allow for tolerance variations that occur during manufacturing of the sash window 12, and more particularly, variations in the openings punched into the top rail 20 that receive the tabs 40,42.

Figure 6:
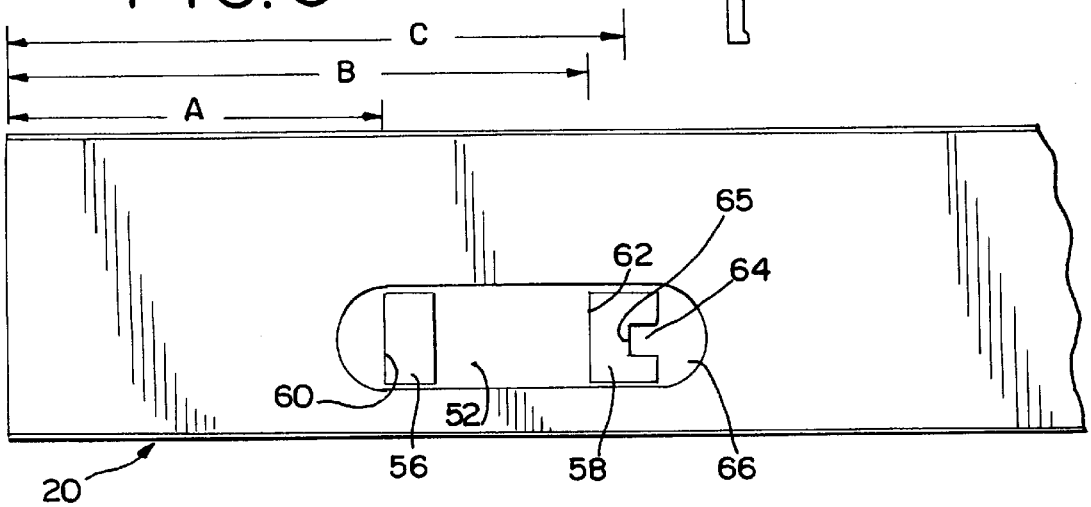
FIG. 6 is a partial top plan view of a top sash rail or extrusion.

The hardware mounting of the present invention can be installed in a variety of different support structures having a cavity to receive the hardware mounting. With the tilt-latch 10, the support structure is the top rail 20 of the window sash 12 and in a preferred embodiment, the tilt-latch is mounted within the top rail 20. FIGS. 6–9 disclose in greater detail the top rail 20 of the window sash 12. The top sash rail 20 has an upper or first wall 50, an intermediate or second wall 52, and a lower wall 54. The top rail 20 is typically made from extruded plastic and commonly referred to as an extrusion. The top rail 20 shown in FIGS. 6–9 has three walls but the top rail 20 could only two walls if desired or more walls if desired. In fabricating the window sash 12, the top rail 20 is welded to the stiles 24,26. Thus, the upper wall 50, intermediate wall 52 and lower wall 54 are welded to walls of the stile at respective end points 50*a*,52*a*,54*a* thereof (FIG. 8). As explained in greater detail below, these connections can affect tolerances between the tilt-latch 10 and top rail 20. The intermediate wall 52 is positioned between the upper wall 50 and the lower wall 54 and thus, in this embodiment, is an inner wall. The support structure has a chamber therein which is defined by an inner wall. In the case of the top rail 20, a chamber 21 (FIG. 7) is defined between the upper wall 50 and the intermediate wall 52. As shown in FIG. 6, the intermediate wall has a first opening 56 and a second opening 58. The first opening 56 and the second opening 58 are positioned along the intermediate wall 52 at a location spaced from an outer surface of the stile 24. The first opening 56 begins at a first distance "A" from the stile 24 and the second opening begins at a distance "B" from the stile 24. A portion of the first opening 56 defines a first stop wall 60 and a portion of the second opening 58 defines a second stop wall 62. Thus, the distance from an outer surface of the stile 24 to the first stop wall 60 corresponds to the first distance "A" and the distance from the outer surface of the stile 24 to the second stop wall 62 corresponds to the second distance "B." Further, the intermediate wall 52 has a protrusion 64 extending into the second intermediate wall opening 58. The protrusion 64 has a protrusion surface 65 facing the second stop surface 62. The distance from an outer surface of the stile 24 to the protrusion surface 65 corresponds to a distance "C." Similar to the protrusion 64 extending into the second opening 58 in the intermediate wall, a protrusion may also extend into the first opening 56 in the intermediate wall (not shown) if desired. Additionally, it is understood that two openings in the intermediate wall are not required. One opening with a corresponding tab is sufficient to contain the tilt-latch of the present invention within the sash window. In a preferred embodiment at least a portion of one of the intermediate wall openings 56,58 are rectangular-shaped. Also, the walls of the top rail 20 that have the openings 56,58 to receive the tabs 40,42 are preferably horizontal. The openings could be positioned on other walls, such as vertical walls to correspond to tabs placed on other walls of the housing.

The upper wall 50 of the top rail 20 has a slot 66 therein as shown in FIG. 6. The slot 66 in the upper wall 50 provides access to the intermediate wall 52. The slot 66 also provides access to tilt-latch 10 inserted in the top rail 20. In a preferred embodiment, the slot 66 in the upper wall 50 is positioned over the first and second intermediate wall openings 56,58. When the tilt-latch 10 is installed in the top rail 20, the slot 66 is positioned over the actuator 33 or control button 33 of the latch bolt 32. Thus, the slot 66 in the upper wall 50 allows an operator access to frictionally engage the latch bolt 32 of the tilt-latch 10 to retract the latch bolt 32 into the housing 30 for releasing the sash window 12 from the master frame. More specifically, the operator engages the latch bolt 32 via an actuator 33 on the latch bolt 32 through the slot 66 in the upper wall 50.

Figure 7:
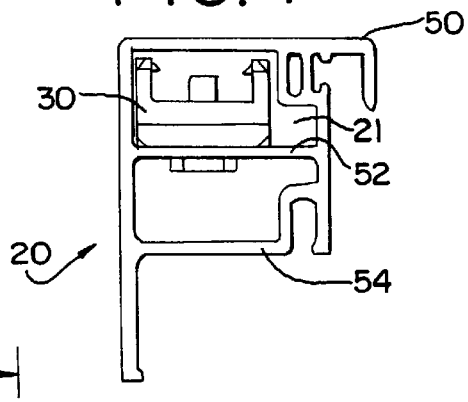
FIG. 7 is an end elevational view of the top sash rail or extrusion, including the tilt-latch of the present invention mounted therein.

FIG. 7 displays an end view of the top rail 20 of the sash window with the tilt-latch 10 installed therein. Similarly, FIGS. 8 and 9 display cross-sectional side views of the top rail 20 of the sash window with the tilt-latch 10 installed therein. As can be appreciated from FIGS. 1 and 9, the stiles 24,26 and top rail 20 cooperate to form an outer end opening 51. The outer end opening is in communication with the chamber 23 defined by the top rail wherein the tilt-latch 10 can be inserted into the top rail 20 through the outer end opening 51. Thus, in a preferred embodiment, the tilt-latch 10 is inserted from a side of the stile 24 and into the top rail 20 although there are, of course, other known installation methods.

As will be understood from FIGS. 5–9, upon initial insertion of the tilt-latch 10 into the top rail 20 of the sash window 12, the angled surfaces 46,48 of the tabs 40,42 sequentially engage and slide or move along the intermediate wall 52 of the top rail 20. It is understood that the angled surfaces 46,48 allow the tabs 40,42 to move past the stile 24 after initial engagement and move to the intermediate wall 52. Upon further insertion, the angled surfaces 46,48 of the tabs 40,42 frictionally engage and slide or move along the intermediate wall 52. The first flexible member 40*a* allows the first tab 40 to flex upwards, and the second flexible member 42*a* likewise allows the second tab 42 to flex upwards. As can be appreciated from FIGS. 8 and 9, sufficient clearance is provided in the housing 30 for the tabs 40,42 to flex upwards without contacting the latch bolt 32. At a certain point following insertion of the tilt-latch into the top rail 20, one or both of the first and second tabs 40,42 will spring from being displaced within the housing 30 to their normal position (see FIG. 8). This takes place when the tabs 40,42 are located over openings 56,58 respectively, in the intermediate wall 52. At an intermediate position, it is understood that the second tab 42 is received by the first opening 56. As the housing 30 continues to be inserted into the top rail 20, however, the second angled surface 48 engages the intermediate wall 52 at a downstream end of the first opening 56 which allows the second tab 42 to deflect out of the first opening 56 and continue to move along the intermediate wall towards the second opening 58. As the housing 30 continues to be inserted, the second tab 42 is eventually received by the second opening 58. At such time, the tabs 40,42 are received by said openings 56,58. Specifically, the first tab 40 is adapted to be received by the first intermediate wall opening 56. Once the first tab 40 snaps into the first opening 56, the first tab surface 41 is adapted to engage the first stop wall 60 of the first opening 56. Similarly, the second tab 42 is adapted to be received by the second intermediate wall opening 58. Once the second tab 42 snaps into the second opening 58, the second tab surface 43 is adapted to engage the second stop wall 62 of the second opening 58. In addition, the protrusion 64 that extends into the second opening 58 extends into the recess 68 of the second tab 42. The protrusion surface 65 is adapted to engage the recess surface 68*a*. The protrusion surface 65 is dimensioned to a length so that it will engage the recess surface 68*a* and prevent further insertion of the housing 30 into the top rail 20. The leg 39 is also used to prevent excess insertion of the housing 30 into the top rail 20.

Thus, the tilt-latch 10 is securely installed into the top rail without the need for any screw mountings. The upper wall 50 of the top rail 20 prevents the tilt-latch from traveling upwards and the tilt-latch is supported from the intermediate wall 52. As shown in FIG. 7, the top rail 20 also has sidewalls that prevent lateral movement of the tilt-latch 10. The cooperating stop surfaces further prevent unwanted movement along the length of the top rail 20. Specifically, first tab surface 41 engaging the first stop wall 60 prevents movement of the tilt-latch 10 towards the stile 24,26 and out of the top rail 20 through the outer opening in which it was inserted. The second tab surface 43 engaging the second stop wall 62 also prevents movement of the tilt-latch 10 out of the top rail 20. The tilt-latch 10 is also prevented from traveling too far into the top rail 20. As previously discussed, the leg 39 is adapted to engage the outside surface of the stile 24,26. In addition, the protrusion surface 65 engaging the recess surface 68*a* of the second tab 42 also prevents the tilt-latch 10 from traveling too far into the top rail 20. These cooperating surfaces act as a backup to the leg 39 engaging the stile 24,26. As discussed, the first tab 40 could also be configured to receive a protrusion that extends into the first opening 56. It will be understood that the intermediate wall openings 56,58 and tabs 40,42 can be configured to that the tabs 40,42 snap into their respective openings in any sequence, or simultaneously. Thus, it is understood that the tilt-latch 10 is designed to be inserted into the top rail 20 at a set distance wherein the leg 39 or protrusion 65 prevents over insertion into the top rail 20. Once installed, the tabs 40,42 prevent the tilt-latch 10 from moving back towards the stile and out of the outer end opening 51 which is undesirable. As explained below, there is some distance that may exist between the tabs 40,42 and the respective stop surfaces 60,62. While a small distance can be expected to due manufacturing tolerances, the tabs 40,42 are dimensioned to prevent excessive movement towards the stile 24 and out of the outer end opening.

In addition to providing a screwless hardware mounting, the present invention adapts to tolerance variations that can exist in the supporting structure. Specifically, in the tilt-latch 10, the depending tabs 40,42 accommodate for tolerance variations that can exist in the top rail 20. For example, the first and second openings 56,58 are typically punched in the top rail 20 prior to the top rail 20 being connected to the stiles 24,26. Thus, the actual distance between the first opening 56 and the second opening 58 can usually be controlled to expected tolerances. When the top rail 20 is connected to the stiles 24,26, the respective ends are heated and pressed together at the end points of the walls 50*a*,52*a*, 54*a* wherein the top rail 20 is welded to the stile 24,26. As can be appreciated, the size of the welds can affect the positional end locations of the first opening 56 and the second opening 58. Thus, the locations can vary in either direction as represented by arrows A1 and A2 in FIG. 8. Thus, the first distance A from the outer surface of the stile 24 to the first stop surface 60 of the first opening 56 can vary. The second distance B and the distance C can likewise vary in the same fashion. The tilt-latch 10 is dimensioned such that the tabs 40,42 are positioned to snap into the openings 56,58 respectively when the tilt-latch 10 is fully inserted into the top rail 20. Thus, referring to FIGS. 8 and 9, in a most optimum configuration, upon installation, the leg 39 engages the stile 24, the first tab surface 41 engages the first stop surface 60, the second tab surface 43 engages the second stop surface 62 and the protrusion surface 65 engages the recess wall 68*a*. But because of the tolerance variations that are typically present due to the manufacturing process in connecting the top rail 20 to the stile 24, there may be at least some "play" that exists between the tilt-latch 10 and the top rail 20. Thus, the distances A,B,C may be less than expected which will move the first opening 56 and the second opening 58 closer to the outer surface of the stile 24. This will allow movement of the tilt-latch 10 towards the stile 24. While the latch is designed for some "play" to be acceptable, the tabs 40,42 prevent excessive "play" or movement of the tilt-latch 10 back out of the outer end opening 51. There may be at least a first clearance C1 between the first tab surface 41 and the first stop surface 60. Similarly, there may be a second clearance C2 between the second tab surface 43 and the second stop surface 62. There could also be "play" between the leg 39 and the stile 24 as well as between the protrusion 64 and the recess 68. The top rail 20 and tilt-latch 10 and configured to allow for at least some tolerance variations. Thus, after the top rail 20 is welded to the stile 24, the first opening 56 could be shifted resulting in a greater clearance C1 than is desired. This would allow the tilt-latch 10 to move towards the stile 24 until the first tab surface 41 engaged the first stop surface 60. This movement equal to the first clearance C1 could be unacceptable. The second tab 42, however, takes up this extra tolerance. Before the first tab 41 can travel the entire clearance C1, the second tab surface 43 engages the second stop surface 62 and the tilt-latch 10 remains within the allowable movement in the top rail 20. Thus, the second clearance C2 is less than the first clearance C1 preventing the housing 30 from moving towards the outer end opening a distance equal to the first clearance C1. This accounts for the positional variations of the first and second openings 56,58 along the intermediate wall 52. In a most preferred embodiment, the tilt-latch 10 utilized the two tabs 40,42. Similarly, if there was too much clearance between the leg 39 and the stile 24, the protrusion 64 would prevent the tilt-latch 10 from traveling too far into the top rail 20. It is understood that more tabs could be incorporated to further take up tolerance variations. With an increased number of tabs, the greater the opportunity to obtain a most optimum interference fit between a tab and a corresponding opening in the top rail 20. Thus, the support structure or top rail 20 could have a plurality of openings and the tilt-latch housing 30 could have a plurality of spaced tabs that extend from an outer wall of the housing. A respective one of the tabs is adapted to be received by a respective one of the openings. A clearance C is associated between each tab and its respective opening due to the manufacturing tolerances involved. The clearance associated with at least one of the tabs and its respective opening will be less than the other respective clearances whereby movement of the housing within the support structure or top rail a distance equal to any of the other clearances is prevented. In this fashion, the tabs will take up the tolerances that exist between the tabs and openings. It is understood that a clearance C can exist between a tab and opening. This will allow the housing 30 to move a distance equal to the clearance C in the installed state. Using additional tabs will decrease the allowable movement of the housing 30. The movement will be decreased equal to the distance C divided by the number of the tabs N used (C/N). If multiple tabs are used, it is understood that successive openings could utilize a protrusion similar to protrusion 65. The protrusions would be sized to allow the tabs to deflect out of the openings along the length of the support structure until the tab reached its corresponding opening when the housing is fully inserted into the support structure.

Figure 9:
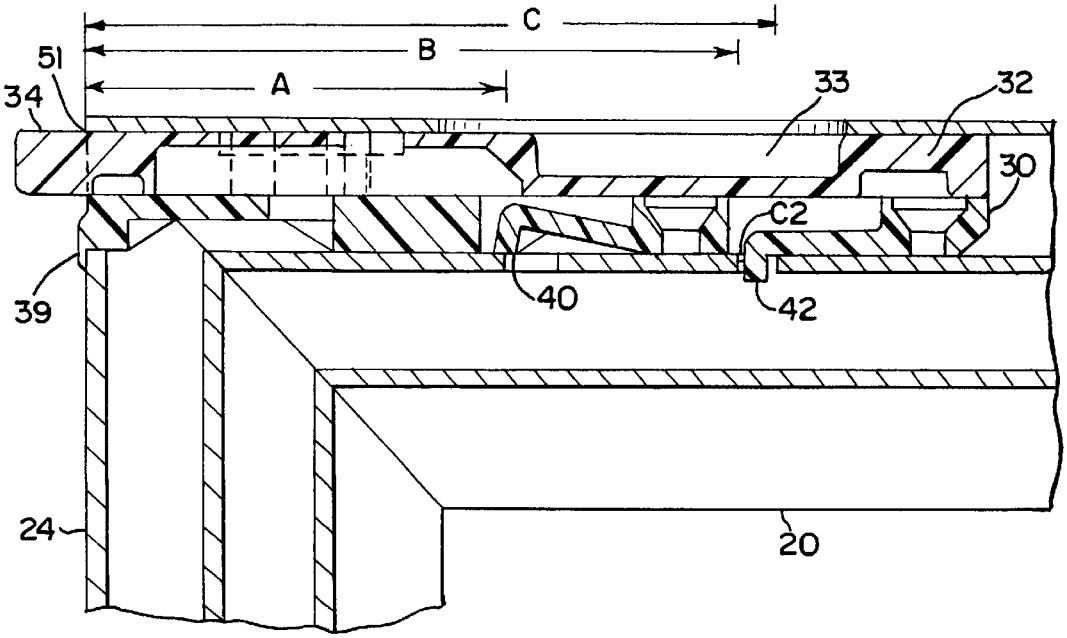
FIG. 9 is a partial front cross-sectional view of the sash window and tilt-latch of the present invention.
Figure 10:
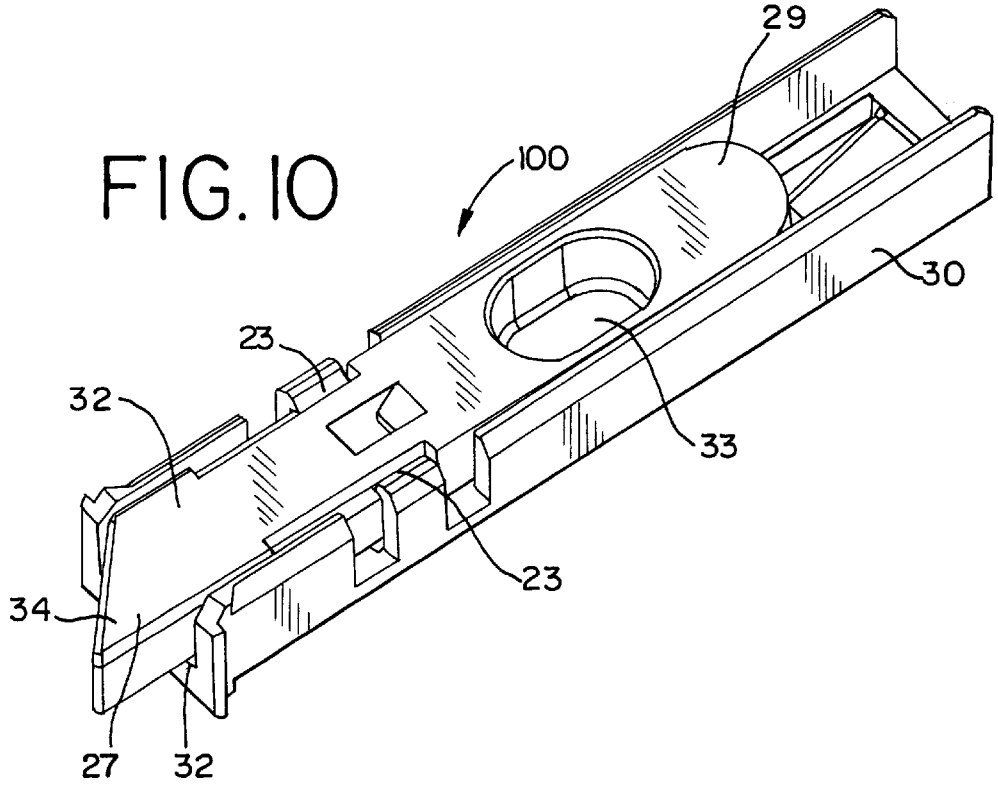
FIG. 10 is a perspective view of another embodiment of the tilt-latch of the present invention.

As further shown in FIG. 9, depending on the tolerances achieved by the attachment of the top rail 20 to the stile 24, the first opening 56 could be shifted out of the acceptable tolerance. In such a case, the first depending tab 40 may not be received in the first opening 56. The second tab 42, however, is received in the second opening 58 allowing for a secure installation even without the first tab 41 being received by the first opening 56. Conversely, the second depending tab 42 may not be received in the second opening 58, while the first depending tab 40 is received in the first opening 56. Accordingly, the tilt-latch 10 of the present invention provides for accounting for manufacturing variations in the frame of the sash window 12. Specifically, the tilt-latch 10 of the present invention provides at least for manufacturing variances found in the location of the first and second openings 56,58 in the intermediate wall 52, and also for the variations found in the distance between the edges of the stiles 24,26 and the location of the first and second openings 56,58. While not preferred, the tilt-latch 10 will remain fixed in the top rail 20 even with only one tab secured in an intermediate wall opening 56,58. In the preferred embodiment, however, shown in FIG. 8, both tabs 40,42 are received by the respective openings 56,58.

As explained above, the configuration of the top rail 20 and the tilt-latch 10 provides for mounting the tilt-latch 10 in the top rail 20 of the sash window 12 without screws. Thus, an internal tilt-latch 10 is provided that does not require screws to mount the latch 10 within the top rail 20 as is typically required. Specifically, the housing 30 is adapted to be supported by the intermediate wall 52 in the top rail 20. More specifically, depending tabs 40,42 and surfaces 41,43 of the tilt-latch, cooperate with the openings 56,58, stop walls 60,62 and protrusion 64 in the top rail 20 to mount the tilt-latch 10 therein. The tabs 40,42 and openings 56,58 cooperate to prevent excessive longitudinal and lateral movement of the housing 30 within the top rail thus minimizing any unwanted noise when operating the tilt-latch. Similarly, the leg 37 of the tilt-latch 10 cooperates with the stile 24,26 to prevent excess longitudinal movement of the housing 30 within the top rail to minimize noise when operating the tilt-latch. It will be understood that the tabs 40,42 and the openings 56,58 can be reversed. The combination of the tab surface engaging the stop wall, the recess engaging the protrusion of the opening, and the leg engaging the stile provides for a secure and vibration free fitment of the tilt-latch in the sash window. Thus, the present invention provides a screwless mounting configuration.

FIGS. 10–14 disclose another embodiment of the hardware mounting of the present invention, again in one preferred application, a tilt-latch 100. The tilt-latch 100 of FIGS. 10–14 is similar to the tilt-latch 10 disclosed in FIGS. 1–9 and similar elements will be referred to with identical reference numerals. The tilt-latch 100 is also adapted to be supported by the top rail 20 shown in FIGS. 6–9. The housing 30 slidingly supports the latch bolt 32 within the housing 30. The housing 30 also includes a first tab 40 and a second tab 42 that extend from the bottom wall 38. The tabs 40,42 are manufactured in this embodiment such that they extend at an angle. This provides a pre-load condition to the tabs 40,42 as the tabs 40,42 are deflected upwards when the housing 30 is inserted into the top rail 20.

Figure 11:
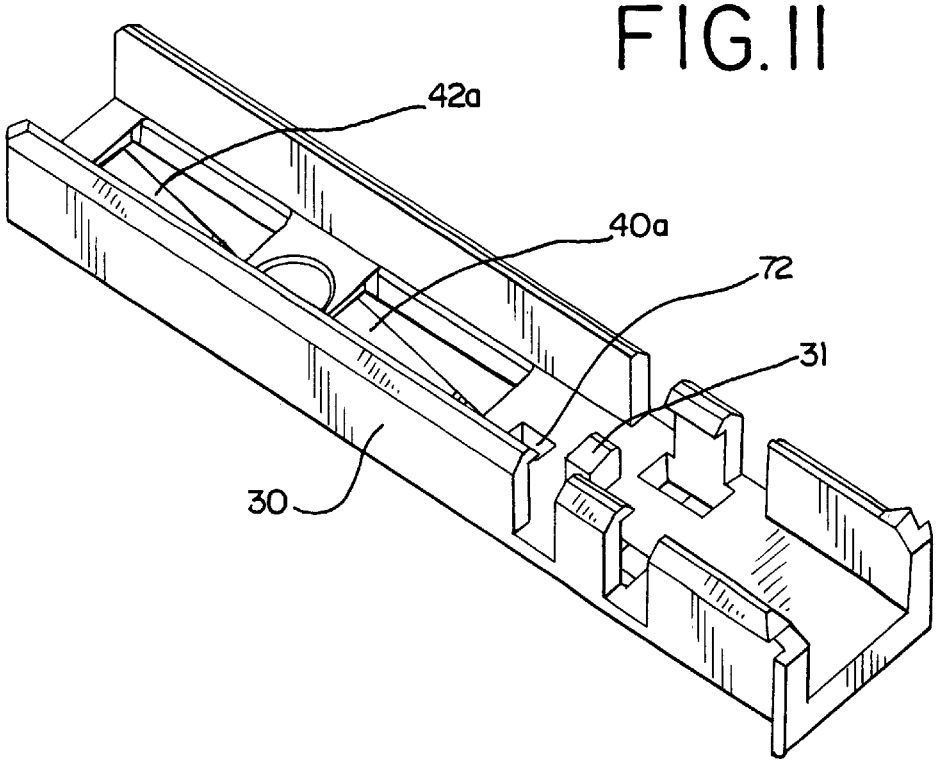
FIG. 11 is a perspective view of a housing of the tilt-latch of FIG. 10.
Figure 12:
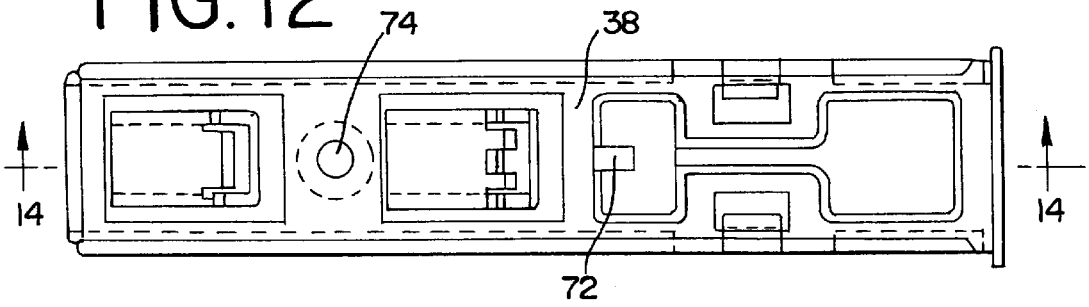
FIG. 12 is a bottom plan view of the housing of FIG. 10.

As shown in FIGS. 11 and 12, the housing 30 has an opening 72 in the bottom wall 38. The opening 72 is positioned adjacent the spring stop wall 31. While unlikely, it is possible that the latch bolt 32 could become damaged and require replacement. To remove the latch bolt, however, the latch bolt 32 must be pried from the housing 30 which could lead to breaking the spring stop wall 31. If this wall 31 is destroyed, the spring 25 will have no wall to abut against to bias the latch bolt 32 out of the housing 30. The opening 72 allows for a "dog and spring" assembly, known in the art, to be incorporated into the tilt-latch wherein the dog portion of the assembly can be inserted into the opening 72 and the spring can then bias the latch bolt 32 out of the housing 30. The housing 30 also has a screw opening 74 if one wants to use a screw mounting. As explained above, however, the screw openings are completely unnecessary in the present invention.

As explained above, the tabs 40,42 have stop surfaces 41,43 that are adapted to engage corresponding surfaces defined by the openings in the intermediate wall of the top rail 20. Because of the placement of the tabs 40,42 along the length of the housing 30, the tabs can allow for tolerance variations of the window sash 12 and still provide for a secure mounting. If there is excessive clearance between the first tab 40 and the first opening 56, the second tab 42 will "take up" that clearance and prevent excessive movement of the latch along the top rail 20. Also, if there is certain clearance between the stile 24 and the leg 39, the protrusion 64 of the second opening 58 abutting the recess surface 68*a* of the second tab will prevent the housing 30 from traveling too far into the top rail 20. As with the tilt-latch 100 of this embodiment, it is understood that the mounting can be achieved with a single tab. In one preferred embodiment, two tabs are utilized. Again, it is further understood that more than two tabs can be used, each tab positioned on the housing to take up excess clearance due to tolerance variations that can exist when the openings are punched into the top rail walls.

Figure 15:
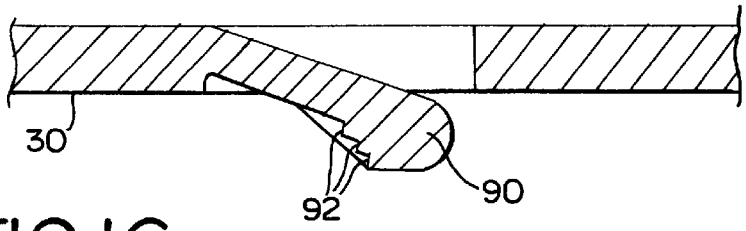
FIG. 15 is a partial schematic view of another housing of the present invention.
Figure 16:
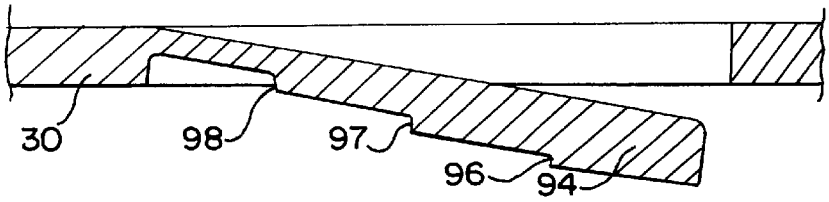
FIG. 16 is a partial schematic view of another housing of the present invention.

The tabs can also be modified to include multiple stop surfaces. As shown in FIG. 15, a tab 90 is shown having a stepped configuration. The stepped configuration defines multiple stop surfaces 92 that are adapted to engage different portions of the wall of the top rail 20. FIG. 16 discloses another tab 94 that is elongated but also with a stepped configuration having multiple stop surfaces 96,97,98. A wall of a top rail could be configured to engage the multiple stop surfaces of these tabs.

Figure 13:
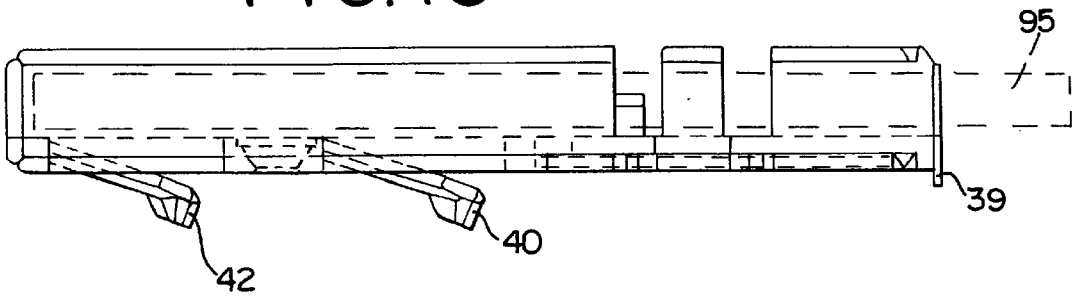
FIG. 13 is a side elevational view of the housing of FIG. 10.
Figure 14:
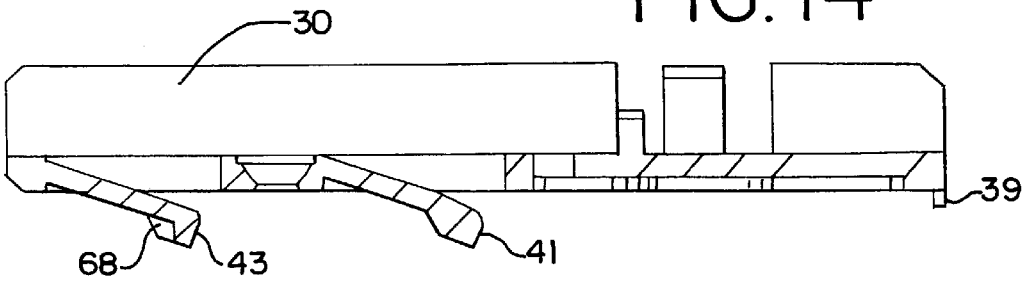
FIG. 14 is a cross-sectional view taken along lines 14—14 in FIG. 12.

It is further understood that the screwless mounting configuration of the present invention is not limited to tilt-latches, although tilt-latches is one preferred application. The hardware mounting of the present invention, however, can be used in many other different applications that can benefit from a screwless mounting. Thus, the hardware mounting is adapted to be mounted in a support structure. The support structure has an inner wall that has an opening. In the tilt-latch embodiment, for example, the support structure is the top rail 20 and the inner wall corresponds to the second wall, or intermediate wall 52 of the extrusion. The support structure could take other forms, however, such as other parts of a window frame, a door frame or even furniture supports. The hardware mounting has the housing, such as a housing similar to housing 30, that is adapted to be supported by the support structure. An outer wall of the housing has a first tab extending from the outer wall. In a preferred embodiment, the outer wall would be a bottom wall. The first tab is adapted to be received by the opening in the inner wall wherein the housing is mounted in the support structure. The tab has a surface that contacts a stop surface defined by the opening wherein the housing cannot move along the support structure. The support structure could also include additional surrounding structure to prevent the housing from falling out of the support structure in other directions. In addition, the housing can support a cooperative member. In the tilt-latch embodiment, for example, the cooperative member corresponds to the latch bolt. The cooperative member could take other forms depending on the application such as a pivot bar supported by the housing or locking structure for a sweep lock adapted to be mounted on a lock rail. As shown in FIG. 13, the housing 30 could be configured to support a cooperative member in the form of a pivot bar 95. The pivot 95 is used to pivotally support a sash window. As in the tilt-latch embodiment, the housing of the hardware mounting could also have a second tab that is adapted to be received in a second opening in the inner wall of the support structure. It is understood that the other features of the housing and tabs explained above could be incorporated into the housing of the hardware mounting. As explained above, the incorporation of the tabs allows for a screwless mounting configuration that also allows for a secure mounting even if the openings in the support structure are formed slightly off tolerance.

Thus, the hardware mounting could be used in still other applications including other window applications. In addition to the pivot bar application, the housing could also support a lock mechanism that locks a double-hung sash window assembly. The mounting could also be used in applications unrelated to windows and doors such as furniture mountings. In general, the mounting could be used in any application where a housing is required to be mounted in a supporting structure especially where it is desirable to not use any screws to assist in the mounting. With respect to the pivot bar application, a hardware mounting having a housing and pivot bar could be incorporated into the pivot-corner/balance shoe assembly 15 shown in FIG. 1. The pivot bar is used to pivotally support the sash window 12. As shown in FIG. 13, for example, the housing 30 supports a pivot bar (shown in phantom) that would cooperate with a balance shoe. The housing 30 can be mounted in the base 22 of the sash window 12 as described above with respect to the mounting in the top rail 20. The housing 30 could also be used to support other hardware mechanisms such as in a sliding door assembly. The housing 30 would typically support another hardware member that interacts with other supporting structure. The housing can be mounted in a cavity without the need for screws. It is also understood that in a preferred embodiment, the tabs 40,42 may extend from a bottom wall of the housing 30. The tabs, however, could extend from other walls of the housing or the bottom wall could constitute other walls of the housing. Accordingly, while the inner wall or intermediate wall is typically a horizontal wall, the inner wall could be other walls such as sidewalls that extend vertically.

While the specific embodiments have been illustrated and described, numerous modifications come to mind without significantly departing from the spirit of the invention and the scope of protection is only limited by the scope of the accompanying Claims.

I claim:

1. A tilt-latch for a sash window disposed within opposed guide rails on a master frame, the tilt-latch comprising:

a housing adapted to be supported by a top rail of the sash window, the housing having a pair of generally vertical side walls connected by a generally horizontal bottom wall which define a channel and a first flexible tab depending from the bottom wall away from said channel, the first tab adapted to be received by a first opening in a wall of the sash window; and, a latch bolt disposed within the housing and having a nose adapted for engaging a respective one of the guide rails.

2. The tilt-latch of claim 1 further comprising a means for biasing the latch bolt through an outward end opening of the housing.

3. The tilt-latch of claim 2 wherein the means for biasing the latch bolt through an outward end opening of the housing comprises a spring.

4. The tilt-latch of claim 1 further comprising a second flexible tab depending from the bottom wall, wherein the second tab is adapted to be received by a second opening in a second wall of a top rail of the window sash.

5. The tilt-latch of claim 4 wherein the second tab has a second tab surface, the second tab surface adapted to engage a second stop wall of the second opening in the second wall.

6. The tilt-latch of claim 1 further comprising a leg proximal an end of the housing and adapted to engage a stile.

7. The tilt-latch of claim 1 wherein the first tab has a tab surface adapted to engage a stop wall of a first opening in a second wall of a top rail of the window sash.

8. The tilt-latch of claim 1 wherein the first tab has a recess adapted to receive a protrusion of a second wall of a top rail of the window sash.

9. The tilt-latch of claim 8 wherein the protrusion has a protrusion surface and the recess has a recess surface, the protrusion surface adapted to engage the recess surface.

10. The tilt-latch of claim 1 wherein the latch bolt adapted to be accessible through a slot of a first wall of a top rail.

11. The tilt-latch of claim 10 wherein an actuator of the latch bolt is adapted to be positioned under the slot.

12. The tilt-latch of claim 1 further comprising a second flexible tab depending from the bottom wall, the second tab having a recess adapted to receive a protrusion extending into the first opening in a second wall.

13. A tilt-latch for a sash window disposed within opposed guide rails on a master frame, the tilt-latch comprising:

a housing having a pair of substantially vertical sidewalls connected by a generally horizontal bottom wall which define a channel, the housing having a first end and a second end, the housing further having a first flexible tab located between the first and second ends, the first tab extending from the bottom wall away from said channel, the first tab adapted to be received by a first opening in an intermediate wall of the sash window; and, a latch bolt disposed within the housing and having a nose adapted for engaging a respective one of the guide rails.

14. A tilt-latch for a sash window disposed within opposed guide rails on a master frame, the tilt-latch comprising:

a generally U-shaped housing having a bottom generally horizontal wall and opposing side walls extending generally vertically upwardly from the bottom wall which define a channel, the housing having a first end and a second end, the housing further having a first flexible tab extending from the bottom wall of the housing between the first and second ends away from said channel, the first tab adapted to be received by a first opening in a wall of the sash window; and, a latch bolt disposed within the housing and having a nose adapted for engaging a respective one of the guide rails.

15. The tilt-latch of claim 14 further comprising a means for biasing the latch bolt toward the first end of the housing.

16. The tilt-latch of claim 14 further comprising a leg extending from the housing proximal the first end thereof and adapted to engage a stile.

17. The tilt-latch of claim 14 further comprising a second flexible tab extending from the bottom wall between the first and second ends thereof and spaced from the first tab, the second tab adapted to be received by a second opening in an intermediate wall.

18. The tilt-latch of claim 17 wherein a portion of the second tab extends substantially perpendicular to the bottom wall defining a second tab surface.

19. The tilt-latch of claim 17 wherein the second tab has a recess and the intermediate wall has a protrusion extending into the second opening, the recess adapted to receive the protrusion.

20. The tilt-latch of claim 17 wherein the second tab has an angled surface, the angled surface being adapted to engage the intermediate wall when the tilt-latch is inserted into the top rail.

21. The tilt-latch of claim 14 wherein a portion of the first tab extends substantially perpendicular to the bottom wall defining a first tab surface.

22. The tilt-latch of claim 14 wherein the first tab has an angled surface, the angled surface being adapted to engage an intermediate wall when the tilt-latch is inserted into a top rail.

23. The tilt-latch of claim 14 wherein the means for biasing the latch bolt comprises a spring.

24. The tilt-latch of claim 23 wherein the latch bolt has a wall and the housing has a spring stop wall wherein the spring has one end positioned abutting the latch bolt wall and another end abutting the spring stop wall.

25. The tilt-latch of claim 14 wherein the latch bolt has a depression defining a control button.

26. A tilt-latch for a sash window disposed within opposed guide rails on a master frame, the tilt-latch comprising:

housing adapted to be supported by an intermediate wall in a top rail, the housing having an outward end opening and a pair of generally vertical sidewalls connected by a generally horizontal bottom wall which define a channel, the housing further having a first flexible tab, and a second flexible tab each depending from the bottom wall away from said channel, the first tab is adapted to be received by a first opening and the second tab is adapted to be received by a second opening;

a latch bolt disposed within the housing and having a nose adapted for engaging a guide rail, the latch bolt having an actuator adapted to be engaged through a slot of an upper wall of said sash window; and, means for biasing the latch bolt through the outward end opening.

27. The tilt-latch of claim 26 wherein the intermediate wall further has a protrusion extending into the first opening and the first tab has a recess, the recess adapted to receive the protrusion of the first opening.

28. The tilt-latch of claim 26 wherein the intermediate wall further has a protrusion extending into the second opening and the second tab has a recess, the recess adapted to receive the protrusion of the second opening.

29. The tilt-latch of claim 26 wherein the first tab has a first tab surface adapted to engage the first stop wall.

30. The tilt-latch of claim 26 wherein the second tab has a second tab surface adapted to engage the second stop wall.

31. The tilt-latch of claim 26 further comprising a leg extending from the housing proximal the first end thereof, the leg adapted to engage the stile.

32. A tilt-latch for a sash window disposed within opposed guide rails on a master frame, the tilt-latch adapted for releasably securing the sash window to the master frame, the tilt-latch comprising:

a housing adapted to be supported by an intermediate wall in the top rail, the housing having an outward end opening and a generally horizontal bottom wall which define a channel, the housing further having a first flexible tab and a second flexible tab each depending from the bottom wall away from said channel, the first tab having a first tab surface and the second tab having a second tab surface, the second tab having a recess therein, the first tab is adapted to be received by the first opening wherein the first tab surface is adapted to engage the first stop wall, the second tab is adapted to be received by the second opening wherein the second tab surface is adapted to engage the second stop wall and wherein the recess is adapted to receive the protrusion;

latch bolt adapted to be disposed within the housing and having a nose adapted for engaging guide rail, the latch bolt having an actuator adapted to be engaged through a slot of an upper wall of said sash window; and, means for biasing the latch bolt through the outward end opening.

33. A hardware mounting for mounting in a support structure, the support structure having a cavity with a wall, the wall having a first opening and a second opening, the mounting comprising:

a housing adapted to be supported by the cavity, the housing having generally vertical sidewalls connected to a generally horizontal bottom wall which define a channel, the housing having a first flexible member and a second flexible member formed in the bottom wall away from said channel, the housing further having a first tab extending from the first flexible member and a second tab extending from the second flexible member, the first tab adapted to be received by the first opening in the wall and the second tab adapted to be received by the second opening, a cooperative member disposed within the housing.

34. A hardware mounting system comprising:

a support structure having an inner wall defining a chamber in the support structure, the support structure having an outer wall having an outer end opening in communication with the chamber, the inner wall having a first opening and a second opening spaced from the first opening;

a housing having an outer wall and a first tab and a second tab extending from the outer wall, the second tab having a second angled surface; and, the housing being inserted into the support structure through the outward end opening wherein the tabs move along the inner wall, wherein at a first intermediate position the second tab is received by the first opening and as the housing is further inserted into the support structure, the second angled surface engages the inner wall wherein the second tab deflects out of the first opening and wherein the housing is further inserted into the support structure to an installed position wherein the first tab is received by the first opening and the second tab is received by the second opening.

35. The hardware mounting of claim 34 wherein the first tab has a first angled surface that engages the inner wall as the housing is inserted into the support structure.

36. The hardware mounting of claim 34 wherein the housing has a leg, the leg being positioned adjacent the outer wall when the housing is installed in the support structure.

37. The hardware mounting of claim 34 wherein the first opening defines a first stop wall and the first tab has a first tab surface to engage the first stop wall.

38. The hardware mounting of claim 34 wherein the second opening defines a second stop wall and the second tab has a second tab surface to engage the second stop wall.

39. The hardware mounting of claim 38 wherein the inner wall has a protrusion extending into the second opening and the second tab has a recess, the recess positioned to receive the protrusion.

40. The hardware mounting of claim 39 wherein the protrusion has a protrusion surface and the recess has a recess surface, the protrusion surface positioned to engage the recess surface to prevent excess travel of the housing into the support structure.

41. The hardware mounting of claim 34 wherein the first tab has a first angled surface that engages the inner wall as the housing is inserted into the support structure.

42. The hardware mounting of claim 34 wherein the inner wall has a third opening and the housing has a third tab to be received by the third opening when the housing is inserted into the support structure.

43. The hardware mounting of claim 34 wherein the second tab is received by the second opening before the first tab is received by the first opening.

44. A hardware mounting system comprising:

a support structure having a first member having an inner wall defining a chamber in the support structure, the support structure having an outer surface having an outer end opening in communication with the chamber, the inner wall having a first opening defining a first stop surface, the first stop surface being spaced from the outer surface at a first distance, the inner wall having a second opening having a second stop surface, the second stop surface being spaced from the outer surface at a second distance, the support structure has a second member connected to the first member wherein the first distance and the second distance can vary to due manufacturing tolerances in connecting the first member and second member of the support structure;

a housing having an outer wall and a first tab and a second tab extending from the outer wall; and the housing inserted into the support structure through the outward end opening wherein the first tab is received by the first opening and having a first clearance defined between the first tab and the first stop surface, and wherein the second tab is received by the second opening and having a second clearance defined between the second tab and the second opening, wherein the second clearance is less than the first clearance preventing the housing from moving towards the outer end opening a distance equal to the first clearance thereby accounting for the positional variations of the first and second openings.

45. A hardware mounting system comprising:

a support structure having an inner wall defining a chamber in the support structure, the inner wall having a plurality of spaced openings, each opening defining a stop surface;

a housing having an outer wall and a plurality of spaced tabs extending from the outer wall; and a respective one of the tabs each received by a respective one of the openings, wherein a clearance is defined between each tab and its respective stop surface, wherein the clearance associated with at least one of the tabs arid respective stop surfaces is less than the other respective clearances whereby movement of the housing within the support structure a distance equal to any of the other clearances is prevented.

46. A tilt-latch system comprising:

a sash window having a top rail, a base and two stiles connected together, the top rail having a first wall and a second wall defining a chamber there between, the stile having an outer opening in communication with the chamber, the second wall having first opening and a second opening;

a housing supported in the top rail, the housing having an outer wall and a first tab and a second tab extending from the outer wall, the second tab having a second angled surface;

the housing inserted into the top rail through the outer opening wherein the tabs move along the second wall, wherein at a first intermediate position the second tab is received by the first opening and as the housing is further inserted into the support structure, the second angled surface engages the inner wall wherein the second tab deflects out of the first opening and wherein the housing is further inserted into the support structure to an installed position wherein the first tab is received by the first opening and the second tab is received by the second opening; and a latch bolt disposed within the housing.

47. A tilt-latch system comprising:

a sash window disposed within opposed guide rails on a master frame, the sash window having a top rail, a base and two stiles connected together, the top rail having a first wall and a second wall defining a chamber there between, the second wall having a plurality of spaced openings, each opening defining a stop surface, the tilt-latch adapted for releasably securing the sash window to the master frame;

a housing supported in the top rail, the housing having an outer wall and a plurality of spaced tabs extending from the outer wall; and a respective one of the tabs each adapted to be received by a respective one of the openings, wherein a clearance is defined between each tab and its respective stop surface, wherein the clearance associated with at least one of the tabs and respective stop surface is less than the other respective clearances whereby movement of the housing within the top rail a distance equal to any of the other clearances is prevented.

* * * * *